US005921332A

United States Patent [19]

Spedale, Jr.

[11] Patent Number: 5,921,332

[45] Date of Patent: Jul. 13, 1999

[54] APPARATUS FOR FACILITATING REMOVAL OF A CASING OF AN OVERBURDEN DRILLING EQUIPMENT FROM A BORE

[75] Inventor: Angelo Lee Spedale, Jr., Cypress, Tex.

[73] Assignee: Sandvik AB, Sandviken, Sweden

[21] Appl. No.: 08/998,648

[22] Filed: Dec. 29, 1997

[51] Int. Cl.[6] ..... E21B 10/36

[52] U.S. Cl. ..... 175/415; 175/171

[58] Field of Search ..... 175/401, 171, 175/320, 415, 390

[56] References Cited

U.S. PATENT DOCUMENTS 3,269,470 8/1966 Kelly ..... 175/415 X
3,982,596 9/1976 Vetter ..... 175/426
5,255,960 10/1993 Ilomäki .
5,590,726 1/1997 Jarvela et al. ..... 175/415 X

*Primary Examiner*—David J. Bagnell
*Assistant Examiner*—Sunil Singh
*Attorney, Agent, or Firm*—Burns, Doane, Swecker & Mathis, L.L.P.

[57] ABSTRACT

An overburden drilling device includes a drill bit body, a percussion element for applying impacts to the body, and a casing attached to the body. The casing is connected to the drill bit body by a casing shoe. The casing shoe and the drill bit body are interconnected by radially overlapping walls so that the drill bit body pulls the casing along during a drilling operation while rotating relative thereto. A wedge-shaped member is provided around the casing close to a rear end of the casing shoe so as to facilitate removal of the drilling equipment from a bore.

11 Claims, 3 Drawing Sheets

APPARATUS FOR FACILITATING REMOVAL OF A CASING OF AN OVERBURDEN DRILLING EQUIPMENT FROM A BORE

BACKGROUND OF THE INVENTION

1) Technical Background

The present invention relates to overburden drilling equipment, wherein the overburden drilling equipment comprises a drill bit body having a connection section at a rear end for connection to a percussive unit such as a down-the-hole hammer and defining a rotational axis of a drill bit, and a casing shoe for attachment to a casing, the casing shoe connected to the drill bit body by mutual engagement of a groove and a collar in a lap-joint.

2) Prior Art

Overburden drilling equipment is previously disclosed in Ilomäki U.S. Pat. No. 5,255,960, for example. It has been found favorable to construct overburden drilling Equipment such that the casing and the rock drill bit are relatively rotatable while simultaneously axially connected, so that the drill bit pulls the casing along as the drill bit advances in the ground. Such relative rotation is achieved in the above-named patent by a lap-joint wherein the casing, or a casing shoe attached to the front of casing, radially and axially overlaps the drill bit and is pulled along therewith. It has now been found that removal of the drilling equipment from a bore is complicated by problems such as tendencies for the equipment to stick in the bore, wherein damage can occur to the casing shoe.

An object of the present invention is to provide an overburden drilling equipment, which obviates the above-mentioned drawbacks.

SUMMARY OF THE INVENTION

That and other objects of the present invention have been attained by an overburden drilling equipment comprising a drill bit body, and a casing shoe. The drill bit body, which defines a longitudinal axis of rotation, includes a cutting face at a longitudinal front end of the body, and a connection section at a longitudinal rear end of the body adapted for connection with a percussive unit. The casing shoe is generally cylindrical and is adapted for attachment to a casing. The drill bit body includes a radially outwardly extending, longitudinally forwardly facing first wall. The casing shoe includes a radially inwardly extending, longitudinally rearwardly facing second wall facing the first wall to be engaged and longitudinally advanced thereby during a drilling operation. The casing carries a wedge-shaped member mounted about the periphery of the casing in the vicinity of the casing shoe. The wedge-shaped member has a front rim facing forwardly relative to the drilling direction of the drilling equipment and a rear rim facing rearwardly relative to said drilling direction. The rear rim has a radial thickness that is smaller than a radial thickness of the rear end of the casing shoe.

Preferably, a radial thickness of the front rim of the wedge-shaped member is substantially equal to the thickness of the rear end of the casing shoe.

The wedge-shaped member is preferably an endless, substantially circular ring sized to be slid longitudinally onto the casing, and to be welded thereto.

BRIEF DESCRIPTION OF THE DRAWINGS

The objects and advantages of the invention will become apparent from the following detailed description of preferred embodiments thereof in connection with the accompanying drawings, and in which.

DETAILED DESCRIPTION OF PREFERRED EMBODIMENTS OF THE INVENTION

Figure 1A:
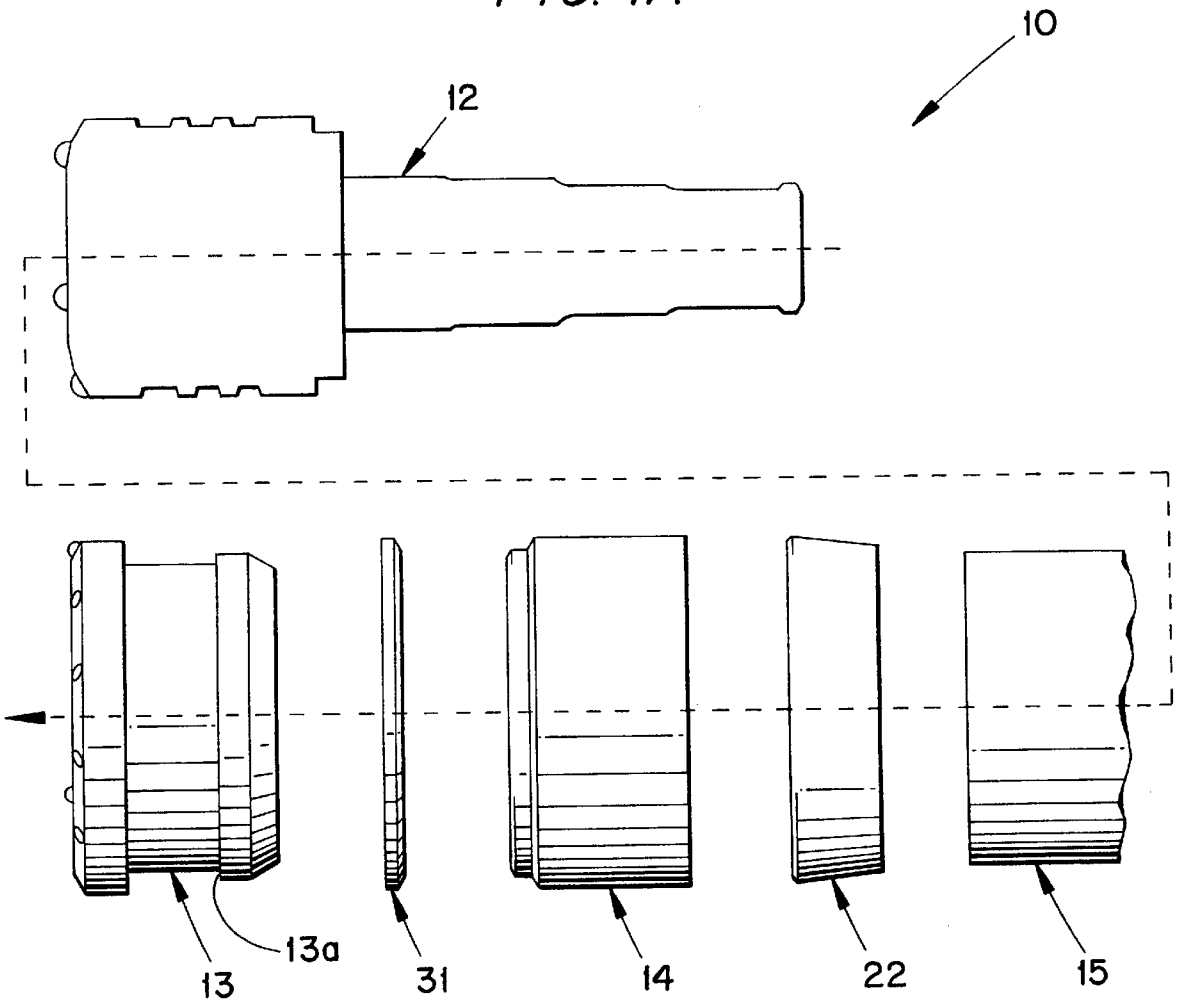
FIG. 1A shows an exploded view of an overburden drilling equipment according to the present invention.
Figure 1B:
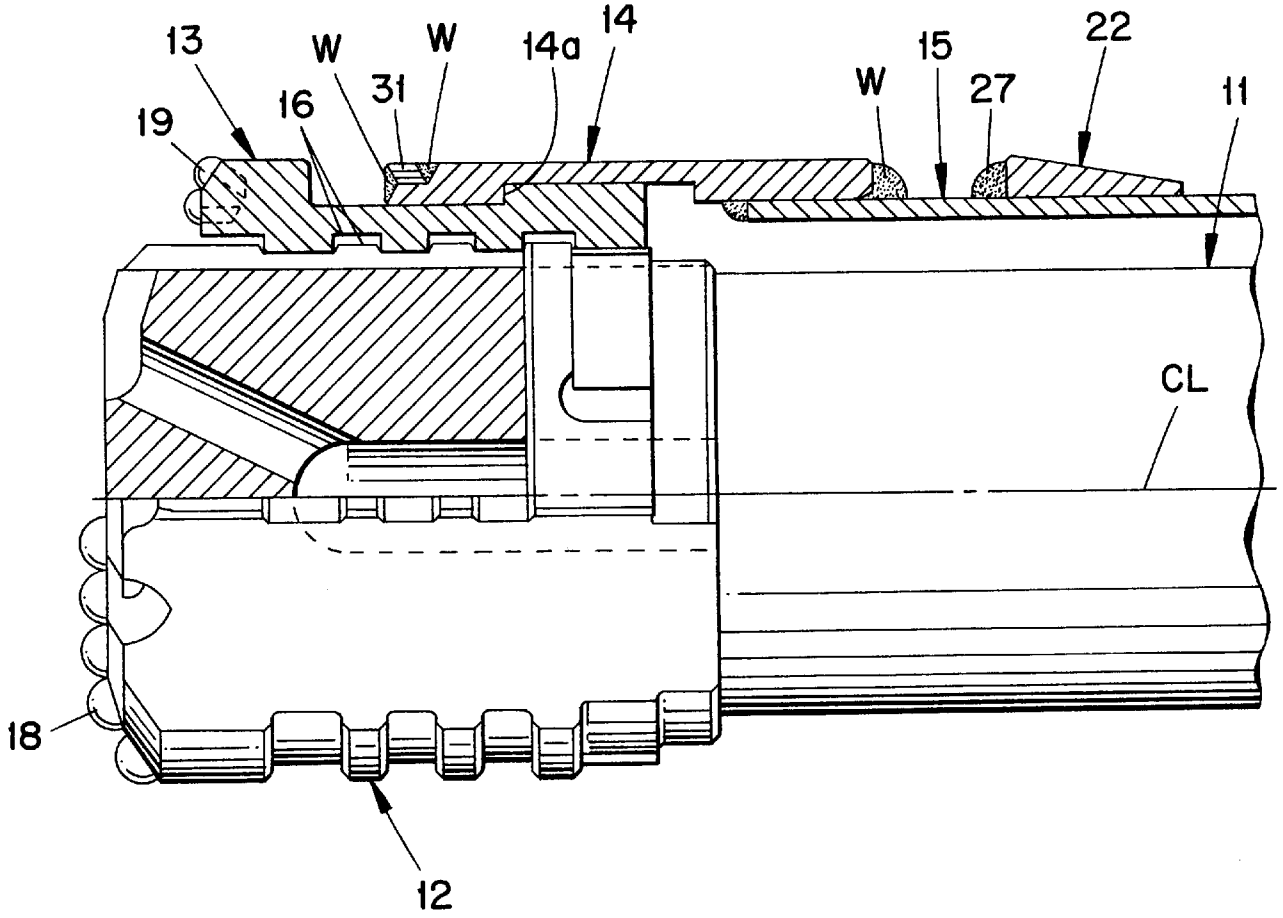
FIG. 1B shows a left half of a pilot bit of the equipment in side view, and a right half of the overburden drilling equipment in longitudinal section.
Figure 1C:
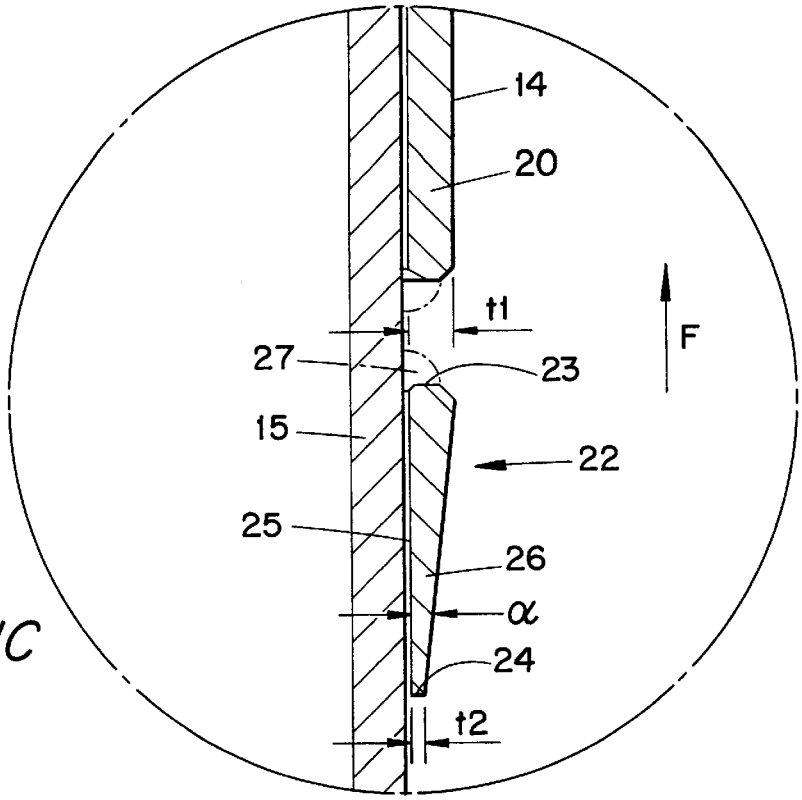
FIG. 1C shows an enlarged section of a wedge-shaped member.

In FIGS. 1A–C there is shown a first preferred embodiment of overburden drilling equipment according to the present invention. The equipment 10 comprises a down-the-hole hammer 11, a pilot drill bit 12, a ring drill bit 13, a casing shoe 14, a wedge-shaped member 22 and a casing 15. The pilot drill bit 12 and the ring drill bit 13 together define a drill bit body.

The hammer 11 is preferably of the pneumatic type and produces axial impacts against the pilot drill bit 12. The casing 15 encircles the hammer 11. The pilot drill bit is provided with cemented carbide inserts 18 and is connected to the ring bit 13 via threads, splines or protrusions 16. The ring bit is provided with cemented carbide inserts 19 and is connected to the casing shoe 14 in a manner allowing relative rotational movement between the ring bit 13 and the casing shoe 14 about the rotational axis CL. The casing shoe is rigidly connected to the casing 15, preferably by means of a weld. That is, the drill bit body 12, 13 includes a radially outwardly extending longitudinally forwardly facing wall 13*a*, and the casing shoe 14 includes a longitudinally rearwardly facing wall 14*a* arranged to be engaged by the wall 13*a* and longitudinally advanced thereby.

As thusfar described, the equipment is similar to the prior art, and the general idea of this kind of equipment is to drill a hole with the equipment and to leave the ring bit, casing shoe and the casing in the hole by uncoupling the pilot bit from the ring bit before retracting the hammer and the pilot bit therefrom. Such a drilling equipment has been described in applicant's U.S. Pat. No. 5,839,519, which is hereby incorporated by reference into the present application.

It is, however, often desirable to retract the entire equipment if the ground around the casing is of such a nature as to remain stable after retraction of the equipment or if the ground is to be stabilized by means of grouting. For that purpose the applicant has now developed an element in the form of a wedge-shaped member 22 for reducing retraction forces.

The casing shoe 14 comprises two substantially identical, mirror-imaged halves of generally semi-cylindrical shape. A ring 31 is provided to position the two halves in preparation for applying welds W.

Figure 1D:
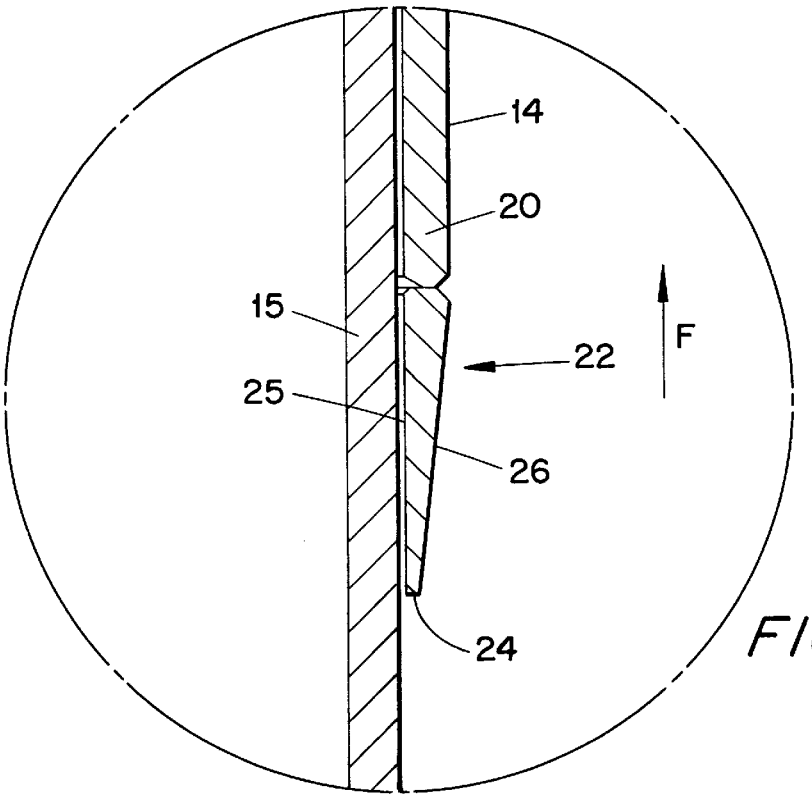
FIG. 1D is similar to FIG. 1C but shows a second embodiment of the invention.

Turning now to FIG. 1C, an enlarged cross-sectional view of a portion of the drilling equipment is shown. The rear end 20 of the casing shoe 14 is secured to the casing 15, preferably by welding. The rear end 20 has a first thickness ti in a radial direction. The casing 15 carries the wedge-shaped member 22. The wedge-shaped member is mounted about the periphery of the casing in the vicinity of the casing shoe. That is, there is a space in the longitudinal direction between the member 22 and the casing shape as shown in FIG. 1C. Alternatively, the member 22 could be welded to the rear end 20, as shown in FIG. 1D. The member 22 has a first rim 23 facing forwardly relative to the drilling direction F of the drilling equipment and a second rim 24 facing rearwardly relative to said drilling direction F. The second rim 24 has a thickness t2 in the radial direction that is smaller than the first thickness t1 of the rear end 20. The wedge-shaped member encircles the casing and is secured thereto preferably by means of one or more welds. The thickness of the first rim 23 of the wedge-shaped member in the radial direction is substantially equal to the thickness ti of the rear end 20. The wedge-shaped member has radially inner 25 and outer 26 surfaces defining between them an acute angle $\alpha$ within the range of 3 to 15°, preferably 5 to 10° and most preferably about 6°. The outer surface 26 faces both radially outwardly and longitudinally rearwardly. The wedge-shaped member is an endless, substantially circular ring, sized to longitudinally enter the casing. Alternatively, the ring can be made from two halves which can be welded together during assembly of the drilling equipment.

The wedge-shaped member 22 is mounted to the casing 15 in the following way. The member 22 is slipped axially over the casing 15 such that the member is positioned generally as shown in FIG. 1B. The two halves of the casing shoe 14 are welded together over the ring bit 13 so as to form a rotatable joint therewith. Then the casing shoe is slipped over the free end of the casing and welding is performed by first welding the rear end 20 to the casing and by welding the forward free end of the casing to the inside of the casing shoe rearward of the rotatable joint. Then the forward rim 23 of the member 22 is welded to the casing 15, thereby creating an axially forward weld 27. It is desirable to keep the rearward rim 24 as thin as possible so as to minimize available abutment surface at the rim 24, thereby minimizing the force needed to retract the drilling equipment. It is therefore favorable to weld only the forward rim 23 to the casing.

In operation of the overburden equipment, the drill bit body is rotated while being impacted by the percussion device, to drill a hole. As the bit body advances, a wall of the ring bit engages a wall of the casing shoe to pull the casing along. By the term "wall" are here included also known solutions as spots of welds or wire. Fluid is conducted through internal passages to the front of the bit body to cool and clean the inserts 18. That fluid, along with cuttings entrained therein, exits the hole through a return channel disposed radially internally of the casing shoe, and then travels within the casing 15.

When retracting the equipment, the frusto-conical outer surface 26 of the wedge-shaped member 22 may encounter objects such as soil, rocks, etc. In that event, the inclined surface will displace such objects radially outwardly, thereby facilitating rearward travel of the equipment.

The invention can be varied freely within the scope of the appended claims. Although the present invention has been described in connection with preferred embodiments thereof, it will be appreciated by those skilled in the art that additions, deletions, modifications, and substitutions not specifically described may be made without departing from the spirit and scope of the invention as defined in the appended claims.

What is claimed:

1. Overburden drilling apparatus for drilling a hole, comprising:

a drill bit body defining a longitudinal axis of rotation and including a cutting face at a longitudinal front end of the body, and a connection section at a longitudinal rear end thereof adapted for connection with member; and a casing arranged coaxially behind the drill bit body;

a generally cylindrical casing shoe attached to the casing and including a rear end having a radial thickness;

the drill bit body including a radially outwardly extending longitudinally forwardly facing first wall, the casing shoe including a radially inwardly extending longitudinally rearwardly facing second wall facing the first wall to be engaged and longitudinally advanced thereby during a drilling operation, while permitting the drill bit body to rotate relative to the casing shoe; and a wedge-shaped member carried by the casing behind the casing shoe, the wedge-shaped member being mounted about the periphery of the casing in the vicinity of the casing shoe, the wedge-shaped member having a front rim facing longitudinally forwarding relative to the drilling direction of the drilling apparatus and a rear rim facing longitudinally rearwardly relative to the drilling direction, wherein the rear rim has a radial thickness smaller than the radial thickness of the rear end of the casing shoe, a radially outer surface of the wedge-shaped member arranged to face both radially outwardly and longitudinally rearwardly.

2. The apparatus according to claim 1, wherein the wedge-shaped member encircles the casing and is fixed thereto.

3. The apparatus according to claim 2, wherein the wedge-shaped member is welded to the casing.

4. The apparatus according to claim 1, wherein the other member connected to the connection section comprises a percussion unit, and wherein the casing encircles the percussion unit.

5. The apparatus according to claim 1, wherein a radial thickness of the front rim of the wedge-shaped member is substantially equal to said radial thickness of the rear end of the casing shoe.

6. The apparatus according to claim 1, wherein the wedge-shaped member has a radially inner surface defining with the outer surface an acute angle within the range of 3 to 15°.

7. The apparatus according to claim 6 wherein the angle is within the range of 5 to 10°.

8. The apparatus according to claim 1, wherein the front rim is longitudinally spaced from the rear end of the casing shoe.

9. The apparatus according to claim 1, wherein the front rim is connected to the rear end of the casing shoe.

10. The apparatus according to claim 1, wherein the drill bit body comprises a pilot drill bit and a ring bit mounted on an outer periphery of the pilot drill bit.

11. The apparatus according to claim 1 wherein the wedge-shaped member is an endless, substantially circular ring sized to be slid longitudinally over the casing, and welded thereto.

* * * * *